US008266830B2

(12) United States Patent
Ma et al.

(10) Patent No.: US 8,266,830 B2
(45) Date of Patent: Sep. 18, 2012

(54) IRONING BOARD HAVING A TILTABLE BODY

(75) Inventors: Kok Wah Ma, Singapore (SG); Derrick Wai Thong Loke, Singapore (SG); Mong Hua Tan, Singapore (SG); Mohankumar Valiyambath Mohankumar, Singapore (SG); Chandra Mohan Janakiraman, Singapore (SG); Swee Loon Michael Tang, Singapore (SG); Choon Hwee Tan, Singapore (SG); Franciscus Jozef Bosman, Drachten (NL); Martijn Van Baren, Drachten (NL); Vignesh Nathamuni Balaji, Singapore (SG); Yong Jiang, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 627 days.

(21) Appl. No.: 11/993,682

(22) PCT Filed: Jun. 28, 2006

(86) PCT No.: PCT/IB2006/052150

§ 371 (c)(1), (2), (4) Date: Dec. 7, 2009

(87) PCT Pub. No.: WO2007/004135

PCT Pub. Date: Jan. 11, 2007

(65) Prior Publication Data

US 2010/0095565 A1 Apr. 22, 2010

(30) Foreign Application Priority Data

Jun. 30, 2005 (EP) ..... 05105961

(51) Int. Cl.
*D06F 81/02* (2006.01)
*D06F 81/00* (2006.01)

(52) U.S. Cl. ..... 38/139

(58) Field of Classification Search ..... 108/1, 6–10; 248/188.1, 188.6; 38/103–140, DIG. 2
See application file for complete search history.

(56) References Cited

U.S. PATENT DOCUMENTS

| | | | | |
|---|---|---|---|---|
| 3,137,953 | A * | 6/1964 | Foster | 38/30 |
| 4,536,978 | A | 8/1985 | Cerutti | |
| 4,689,905 | A * | 9/1987 | Vartan | 38/26 |
| 4,956,929 | A * | 9/1990 | Chirabandalsuk | 38/136 |
| 5,609,047 | A | 3/1997 | Hellman, Jr. et al. | |
| 2003/0000117 | A1 * | 1/2003 | Manfiotto | 38/137 |
| 2004/0050118 | A1 | 3/2004 | Carrubba et al. | |

FOREIGN PATENT DOCUMENTS

| | | | |
|---|---|---|---|
| AU | 199663490 | C | 2/1997 |
| CH | 246634 | A | 10/1947 |
| EP | 0118398 | A1 | 9/1984 |
| EP | 0942096 | A2 | 9/1999 |
| EP | 1024221 | A2 | 8/2000 |
| FR | 2695145 | A1 | 3/1994 |
| WO | 03023123 | A1 | 3/2003 |
| WO | 2004063452 | A1 | 7/2004 |
| WO | 2004097101 | A2 | 11/2004 |

* cited by examiner

*Primary Examiner* — Ismael Izaguirre

(57) ABSTRACT

An ironing board for multifunctional use comprising a base (1), a body (5) with a work surface (6), which body has a first longitudinal axis (I-I) and is connected to the base. A column (7) extends between the body and the base, the column having a second longitudinal axis (II-II) and a tilting means. The tilting means is arranged for tilting the body about a tilting axis (T-T) extending substantially perpendicularly to both the first axis and the second axis. A system comprises such an ironing board and an iron for cooperation with the ironing board. The invention further relates to a method for refreshing an article and a method for pressing an article.

28 Claims, 17 Drawing Sheets

IRONING BOARD HAVING A TILTABLE BODY

Figure 1:
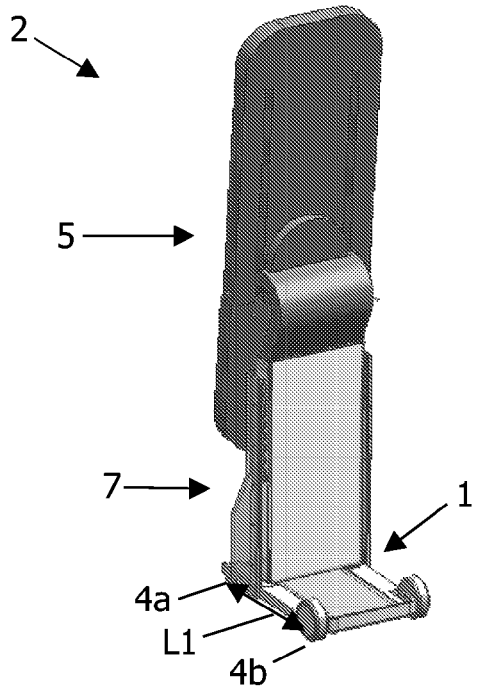

This invention relates to an ironing board comprising a base, a body with a work surface, which body has a first longitudinal axis and is connected to the base. The invention also relates to a system comprising an ironing board and an iron and/or a garment steamer for cooperation with the ironing board. The invention further relates to a method for refreshing an article and a method for pressing an article.

Commonly known ironing boards are equipped with X-legs, the legs are joined at their centre to form a pivot for height adjustment of the board. These ironing boards further comprise a body for placing an article to be ironed. Such an ironing board can be functionally used if the body is in a substantially horizontal position. In that position the feet of the legs function as a base on which the board stands on the floor.

A conventional cross-legged design requires a user to place the ironing board horizontally and almost at floor level, before opening it and raising the ironing board to the required height. For storing the board the reversed steps are taken: the board is lowered to floor level, picked up and put where the user wants to store it. Setting up or storing an ironing board can take considerable space. Furthermore, handling of the board, e.g. moving the board, putting it up or storing it, can be quite a complicated job.

It is an object of the invention to provide an ironing board that is suitable for multifunctional use and is easy to handle when the user wants to put it in a desired operational mode or to store it.

This object is achieved by the ironing board according to the invention, which board comprises a column, which column extends between the body and the base and has a second longitudinal axis, and a tilting means, which tilting means is arranged for tilting the body about a tilting axis extending substantially perpendicularly to both the first axis and the second axis.

The tilting means according to the invention allows for tilting the body relative to the column. In normal operations the column will be substantially vertical. By tilting the body, the user can put the body in several positions or so called operational modes.

The operational modes provide multiple functions for the user. If the body is in a substantially horizontal position, the user can for instance iron an article; if the body is in a tilted position, the user can hang an article over the body to refresh it or to treat it with steam. This will be explained in detail further on. The positions of the body or so-called operational modes can be selected while the column is standing. The user can put the body in the desired position while he/she is standing as well. Therefore, the ironing board according to the invention provides multiple functions and is easy to handle. To store the ironing board according to the invention the user tilts the body in a substantially vertical position and the board is ready to be put where the user wants to store it.

In a practical embodiment the tilting axis is stationary. In an alternative embodiment the tilting axis is rotational whereby a pivot-gliding movement may be made.

An embodiment of the ironing board according to the invention is provided with an axle around which the body can tilt. The axle, serving as a first unit, is fixed to the body and a notch, serving as a second unit, is secured to the column, the units being shaped, particularly complementarily shaped, and coupled to mutually cooperate. In an alternative solution the first and the second unit may comprise a gearwheel design known per se.

In order to be able to put the body in a selected or desired position, a positioning means is preferred. An embodiment of the positioning means comprises a pivot plate having a slot and a pivot clamp having at least one protrusion that fits into the slot. The pivot clamp is connected to the body and the pivot plate is connected to the column. If the protrusion of the pivot clamp is positioned in the slot of the pivot plate, the body is locked in a position. To be able to have several positions for the body, multiple slots can be present. Depending on specific wishes or requirements, the skilled person can incorporate a number of operational modes in the ironing board. The predetermined position or positions are located between 0-90 degrees relative to the horizontal plane, preferably 0-85 degrees relative to the horizontal plane, more preferably around 81 degrees. In a preferred embodiment at least two slots are present on the pivot plate: one at about 0 degrees relative to the horizontal plane and one at about 81 degrees relative to the horizontal plane. These two slots allow for a substantially horizontal body and a tilted body, respectively.

The pivot plate and protrusions function as locking means to avoid rocking of the body relative to the support. In case an increased stability is desired, the pivot clamp might comprise two protrusions fitting into two slots of the pivot plate.

Embodiments with reference to four operational modes are described further on. These modes are: an ironing mode, a refreshing mode, a compact mode and a pressing mode. In these operational modes, optional features according to the invention can be especially beneficial. Embodiments of these features are described further on. In order to be able to describe the optional features in a possible context of an operational mode, the features are described first. Not all the features are described in the context of all—possible—operational modes. The skilled person can combine the features and the modes as he/she deems fit.

In an embodiment of the ironing board according to the invention the body comprises multiple parts, for instance a first part having a first work surface and a second part having a second work surface. The first part of the body is fixed to the column and is preferably provided with a support element for supporting the second part. A hinge, serving as folding means, connects the first and second parts. The hinge, or if desired hinges, allow for the body to be folded. This is a way to create a compact mode. In this compact mode the ironing board is easy to transport and store. For more convenience the base of the ironing board may comprise wheels and the column or board may comprise a handle so that the ironing board can be easily pulled over the floor and the user does not have to lift the ironing board when moving it around. The wheels may comprise blocking means to secure the position of the ironing board, which blocking means are known by the skilled person.

In another operational mode the first work surface and the second work surface are folded towards each other while the first work surface is substantially horizontal. The folded body can be used to press an article in-between the first and second work surface. This is the pressing mode as described further on.

An embodiment of an ironing board according to the invention comprises a resilient element. In practice this can for instance be an elastic band or a strap secured to a spring. The course of the resilient element preferably leads via the column through the first part of the body and ends in the second part of the body. The resilient element is secured at one end to the column and at the other end to the second part of the body. Rollers may function as guiding means to guide the course of the resilient element.

The resilient element functions as a weight balance means to compensate a difference in weight between segments of the body extending at opposite sides of the tilting axis. Due to this measure only a limited force is needed to tilt the board.

In such an embodiment, the resilient element accompanies the folding of the body and prevents slamming in case the user lets go of the board too quickly during folding. In this way folding and unfolding of the body can be done in a controlled manner. The resilient element may further play a role in keeping the parts of the body together while tilting the body. In this case the force of the resilient element has to be stronger than the force needed to tilt the body.

It is to be noted that in case the column is arranged for height adjustment, one end of the resilient element is connected to the moving element of the column and the other end to the second part of the body.

Special care is usually taken in placing an article to be ironed in a flat manner on the work surface of the body. Doubled or folded fabric of the article could—if not taken care of—lead to a self-induced fold or artificial wrinkles in the article after ironing. This is an unwanted effect. In an embodiment of the ironing board according to the invention the ironing board is equipped with means, such as a fan, to blow or suck air through a permeable work surface. The body may be made of permeable material or solid material provided with holes and a permeable cover, for instance made of a textile. The blowing of air through the permeable work surface helps to place the article in a flat manner. The air provides a certain cushion on which the article can be placed in a flat or stretched manner. After the article is placed, the direction of the fan might be changed to suction, for instance by pushing a control button on the iron. Now the fabric of the article, after being placed in a flat manner on the air cushion, is sucked in a flattened manner to the work surface and now ready for ironing, thus reducing the risk of unwanted self-induced folds.

In another embodiment the ironing board may also be provided with means to heat up the work surface. In this way the fabric of the article is warmed from the work surface side, for instance using a hot electric spiral located in the body. Alternatively, a flexible heating element may be attached, e.g. sewn into the cover.

In case the ironing board according to the invention is equipped with a fan and/or a heater, a power supply is needed to supply power to these functions.

In another embodiment of the ironing board according to the invention the work surface is provided with a cover which is made of at least one layer of a heat-resistant fabric that can withstand temperatures from 150 degrees Celsius to 250 degrees Celsius continuously, without scorching. A hot sole of the iron can be placed on such fabric. In this way the user does not have to be bothered with the placing of the iron in a specially designated place or position for instance on a heel rest. Suitable material for the fabric is a woven material of meta-aramid fiber or polybenziimidazole, also liquid crystal polymers can be considered for this purpose. A thickness of up to 5-6 mm for the total cover is preferred. A thicker layer may result in a cover that is too heavy. In practice flame-retardant requirements are taken into consideration when selecting the material for the cover of the body, a self-extinguishing material is preferred. Another benefit of using heat-resistant fabric for the cover is that a stand for the iron is no longer needed. Usually one end of the ironing board is reserved for parking the iron when not in use. Without this so called dedicated iron-parking-place the user is free to use both ends of the board. In case the body has ends that differ in shape and/or size, the user can select the shape/size the most appropriate for the article to be ironed.

In a practical embodiment the cover comprises two layers: a top layer, which can withstand a temperature of 230 degrees Celsius for at least 30 minutes and a bottom layer, such as a felt or foam layer, which can withstand a temperature of 210 degrees Celsius for at least 30 minutes. The top layer is the layer that is in contact with the article during operation such as ironing. The temperatures mentioned are temperatures relevant for ironing. A lot of ironing boards are used in combination with a steam iron; therefore it is preferred that the cover has a cloth which is permeable to air and or steam.

In another embodiment of the ironing board according to the invention the board has a chamber to house appliances such as an iron, a steam iron and/or a garment steamer. This could be a cabinet with a drawer on or in the column in which the user can store for instance an iron when not in use.

Means to operate such appliances might also be provided for. These means may be for instance a water tank for providing water, a boiler for generating steam, in particular generated from the water from the water tank, and supplying steam to an inlet of the iron and a power supply for supplying power. In this way the ironing board and the iron form and cooperate as a system. Alternatively, the steam may be supplied to an inlet of the garment steamer, if present. In this way the ironing board and the garment steamer form and cooperate as a system.

Embodiments of the ironing board according to the invention are described in claims 2 to 29. The system according to the invention is described in any one of the claims 30 to 32. The methods according to the invention are described in claims 33 to 35.

Four operational modes of the ironing board according to the invention will now be described. The ironing board according to the invention is capable of at least two of these operational modes.

A first operational mode is the ironing mode. In this mode the body is usually in a substantially horizontal position. In an embodiment of the ironing board according to the invention the work surface has a contour that corresponds to the contour of a longitudinal section of an imaginary torso. One end of the board according to the invention has the shape of an imaginary human shoulder. The area of the work surface of the body can be chosen in such a size that the back of a shirt can be placed on it in whole. For instance a man's shirt size 52, 54 or 56 might be a convenient size. In this way the back of the shirt can be ironed in one go. The article does not need to be displaced during the ironing process in order to make sure that the whole back is ironed. Also for other articles an area large enough to fit the whole article—or a large portion of it—is beneficial. In this way less movement of the article is needed. The user has to perform fewer actions, which makes the ironing process less tedious and helps to save time.

A second operational mode is the refreshing mode. In one embodiment of an ironing board according to the invention, the board has a refreshing mode. In this mode the user can refresh articles by attaching the article to the body. In another embodiment of the ironing board according to the invention the work surface has a contour that corresponds to the contour of a longitudinal section of a torso. The article can be for instance a jacket, a blazer, a blouse or a shirt. Attaching can be done by hanging the article over the body. The article may be buttoned and thus closed at the what is usually called front side of the article. In this way the shoulder parts hang over the shoulders of the body. A non-button article like a dress or a sweater may be hung over the body in such a way that the shoulder straps or shoulder parts rest on the shoulders of the body. In both descriptions the body of the ironing board is enwrapped or dressed with the article. Alternatively, attaching can also be done by hanging the article on a hanger, and hook the hanger onto the body, or the article may lie loosely on the body; the body may support the article.

In an embodiment of the refreshing mode the body is in a substantially vertical position. The locking means provide multiple positions; this can be any position that provides a functional use. Usually this is between 0 and about 90 degrees. To refresh a shirt, a blazer or dress an angle between 75-85 degrees is beneficial. For a long wide skirt an angle of 30-60 degrees can be beneficial, because that way the fabric can hang free from the apparatus.

In case the user wants to refresh for instance a cloth or a duvet, a substantially horizontal body might be desired.

One way of using the refreshing mode is the following. The user attaches the article to the body and activates the electrical unit to start the fan to produce an air stream. The control unit may be located at any suitable place, for instance at the back of the body or at the column. A suitable place may be a place where the user can easily reach it. The control unit may be a push button, a touch screen, a touch button, a dial or an RF interface. Alternatively, a control unit may be applied that comprises a remote control arranged for communication with an electrical unit for activating a fan. The control unit might be programmable, so a jacket, a shirt or a coat hanging over the body can be refreshed just in time before the owner gets home. In one embodiment according to the invention the air flows through a permeable work surface towards the article. Refreshing an article in this way is more effective than hanging it on a hanger to air.

In one embodiment of the ironing board according to the invention the body comprises at least two parts, a first part connected to the column and a second part connected to the first part. In case the body has multiple parts, the air is guided via air guiding means such as corresponding openings in the sides of the body. In this way the air can flow through the whole body and through both the first and the second work surface.

In an alternative embodiment of the ironing board according to the invention the body is equipped with vents on opposite sides of the body. These are used as refreshing means. During use the vents are opened by means known per se and the air stream is mainly blown out of the vents. The air stream flows towards the sleeves and the upper part of the article. In this way the armpit region, known as a sweat area, is especially refreshed. The sleeves may be puffed out to some extent.

The board may be provided with heating means to warm the air. Warm air may accelerates the refreshing process.

In case the ironing board is part of a system that also comprises a garment steamer, the body can be used to hang the article and the steamer can be activated and moved along the article such that steam contacts the surface of the article. In such a system a boiler, a water tank and the electrical unit would be accommodated and arranged to provide steam to an inlet of the steamer. Optionally, this steaming operation can be combined with refreshing, for instance, after steaming the article it is refreshed.

The ironing board according to the invention may have means to allow for ironing in a non-horizontal mode in case the user prefers this. If the body is inclined upwardly, seen in the direction of a forward stroke of the iron in the iron process, during the forward stroke the frictional force or shear force is increased with respect to such force in case of a horizontally oriented body. This makes the process of wrinkle removal more effective. During a backward stroke of the iron the frictional force is reduced compared to this force in case of a horizontally oriented body thereby providing the consumer more convenience.

The tilted, i.e. inclined body may further provide an ergonomic convenience to the user, this process is similar to a person writing on an inclined desk, which is more convenient as compared to writing on a horizontal desk.

A third operational mode is the compact mode. In an embodiment of the ironing board according to the invention the body can both be tilted and folded. This can be done in such a way that the two body parts are more or less parallel to the column. In this way a compact ironing board results. It is preferred to choose inward folding to prevent stretching of the cover.

Handling of the board, e.g. moving the board, putting it up or storing it or putting it away can be a tedious job. In case the ironing board is equipped with for instance a ventilator for blowing and suction of air through the body, the board can become quite heavy. In the compact mode a substantial height reduction has been achieved as compared to the refreshing mode. In this way the ironing board and in case the board is part of the system, the system is quite easy to store, for instance under a table.

In case the base is provided with wheels, the user can easily pull the compact system to the desired place and set it up for ironing or refreshing. Alternatively, the user could pull the system to the curtains or furniture. In case the ironing board is part of a system that also has a garment steamer and means to supply steam to the steamer. The system can be used to steam and refresh curtains or furniture. In this way for instance smell can be reduced and wrinkles present in a curtain can be reduced.

A fourth operational mode is the pressing mode. Using the pressing mode of the ironing board according to the invention the user can press articles, or parts of articles. In the pressing modes the article is located in-between the first work surface and the second work surface. The parts of the body are clamped together with clamping means. These means may be known per se and a skilled person can select a suitable means. This may be a hook and a protrusion or the like, or a large clip that embraces the first and second part of the body, etcetera.

In one embodiment the clamping means comprise a bistable spring. The clamping means may be electric-power assisted, such as motorised gear or solenoid.

In a preferred mode the body parts are substantially horizontal during use; alternatively a 0-20 degree-angle to the horizontal plane could be selected.

In case the ironing board comprises heating means and/or air blowing or steam means, these might be used while pressing the article to increase the efficiency of the pressing process. In that case the body is made of a permeable hard material with holes covered with for instance a woven cover.

A concept of an ironing board tilting about a column-like set up instead of X-legs is described in FR 2695145. This document hardly provides technical information about setting up of the board. Moreover the tilting illustrated in FR 2695145 does not allow for a refreshing mode according to the invention, because the disclosed device does not have the required tilting possibilities.

With reference to the claims it is further noticed that the invention also refers to all possible combinations of features as described in the claims.

Figure 2:
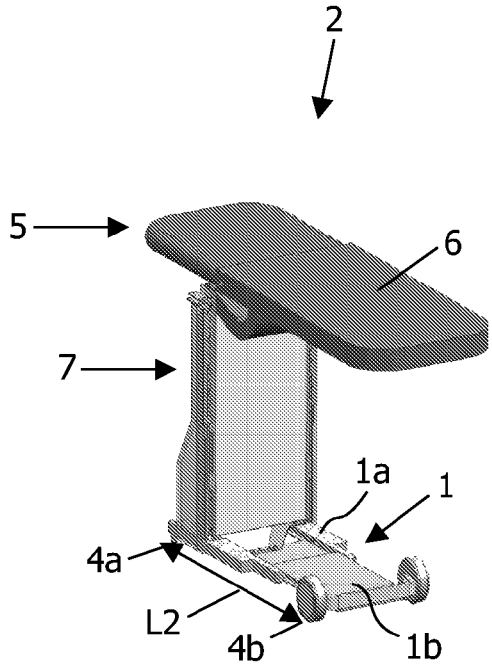
Figure 4:
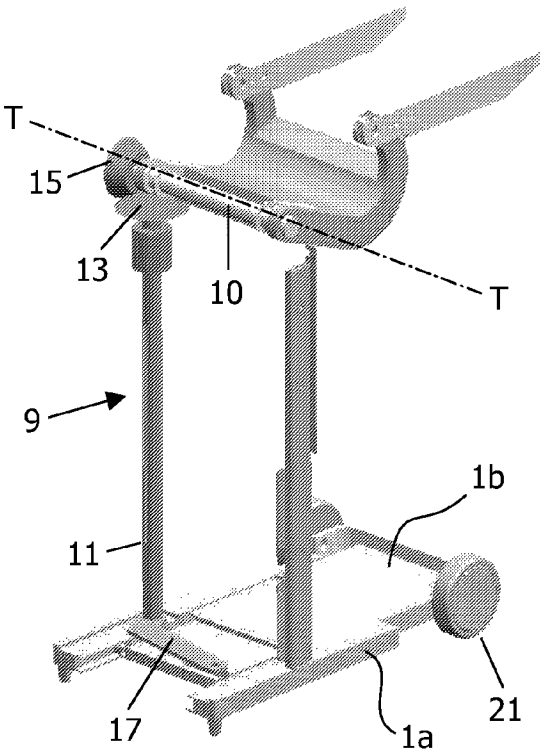
Figure 3:
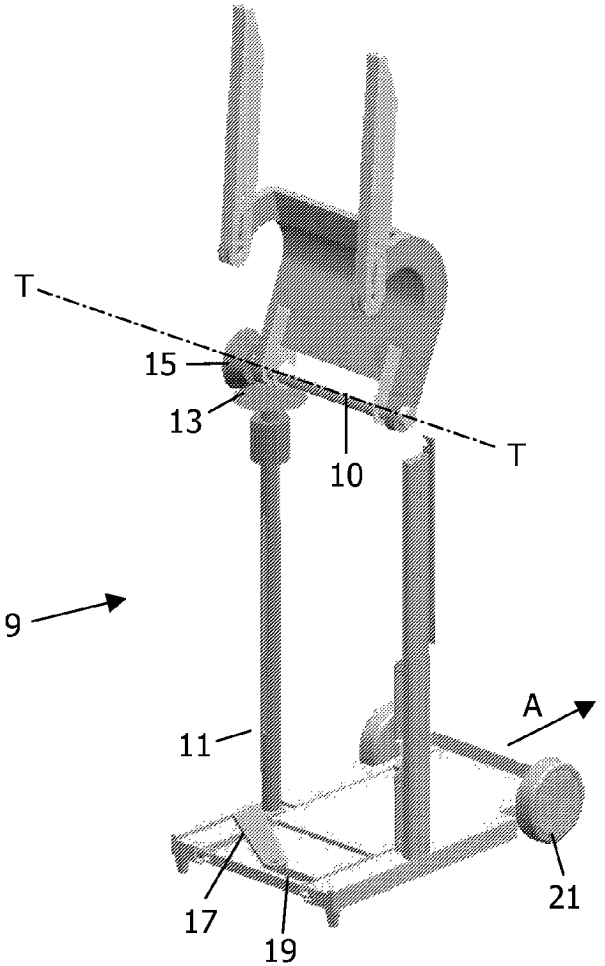
Figure 6A:
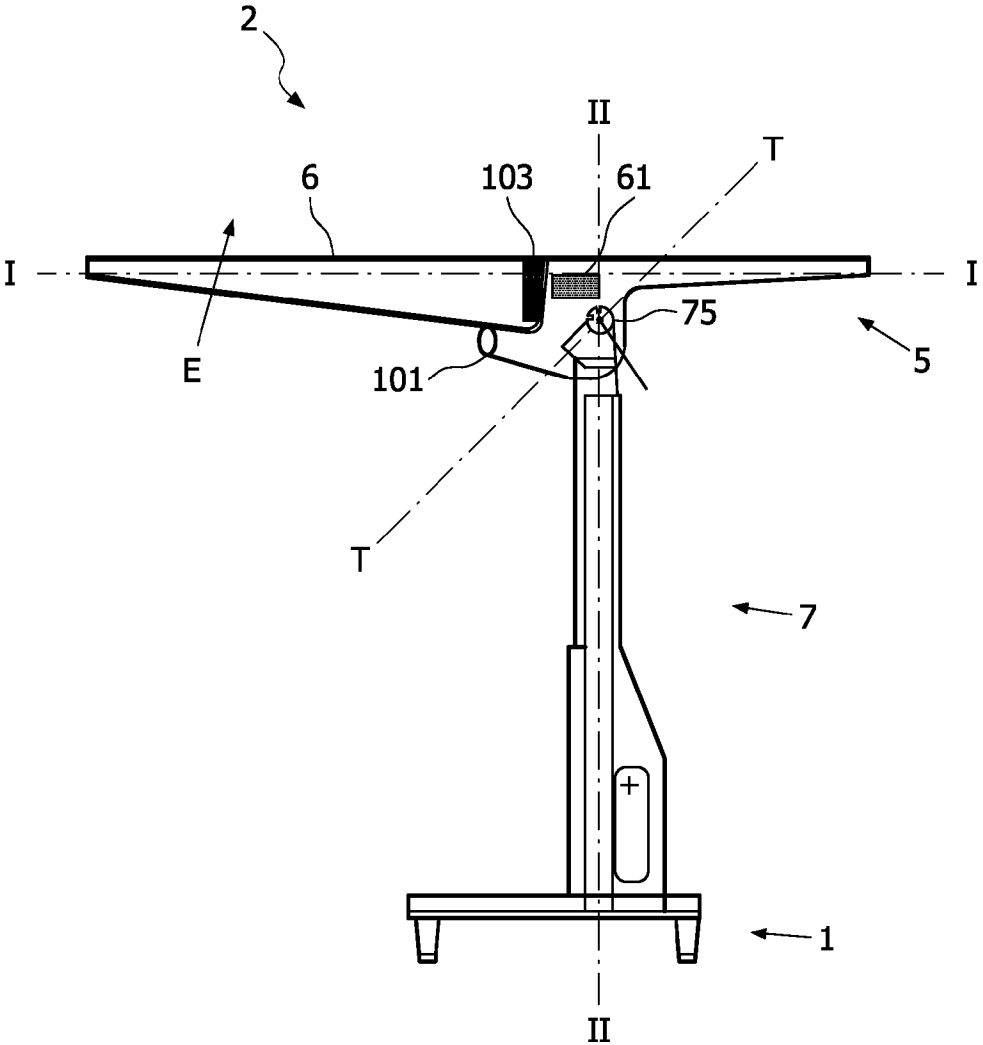
Figure 5:
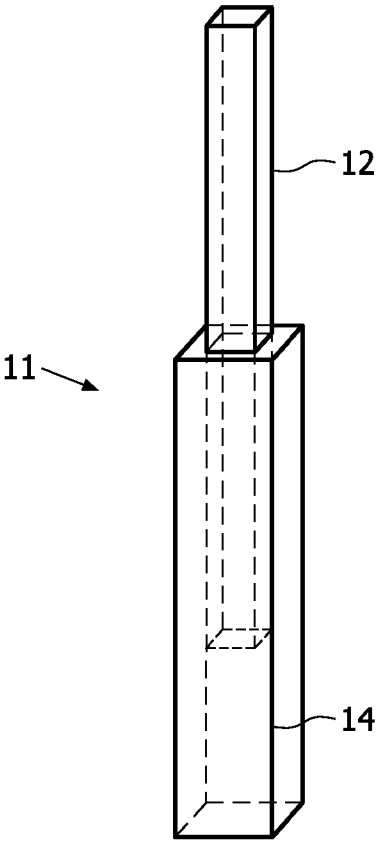
Figure 6B:
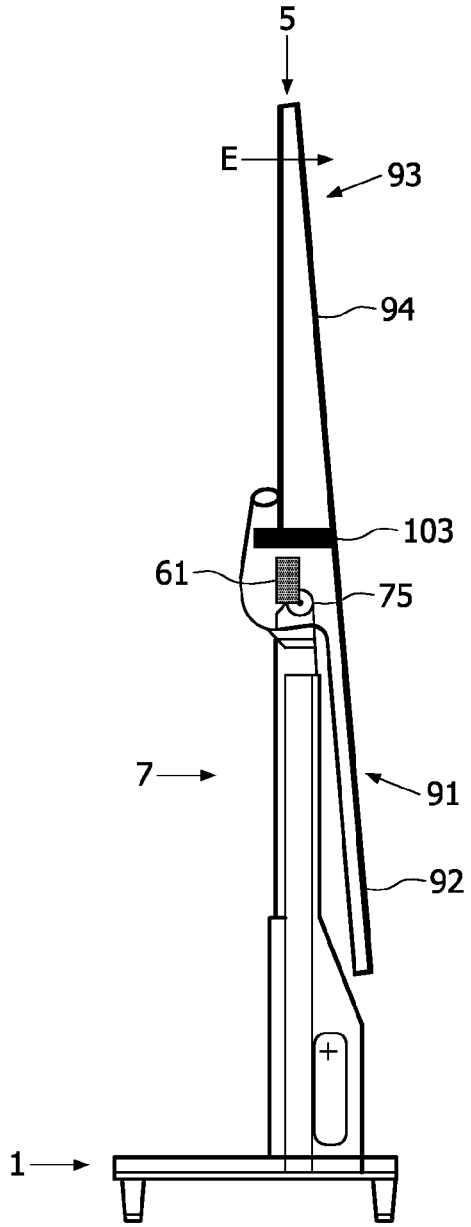
Figure 6C:
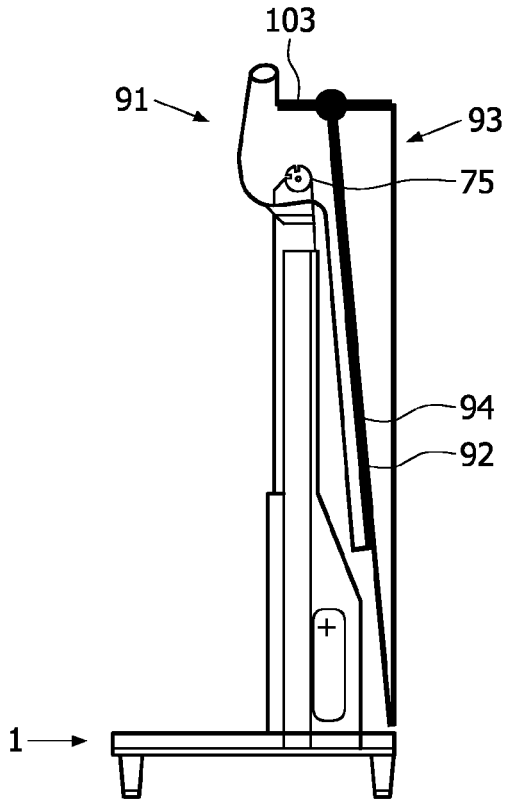
Figure 7:
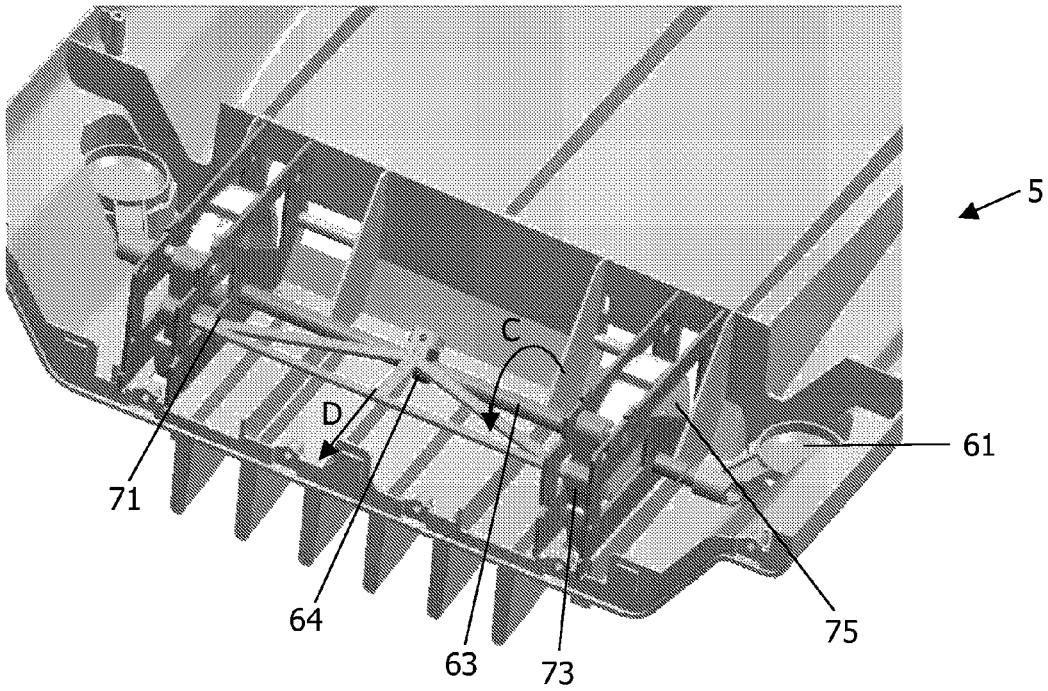
Figure 8:
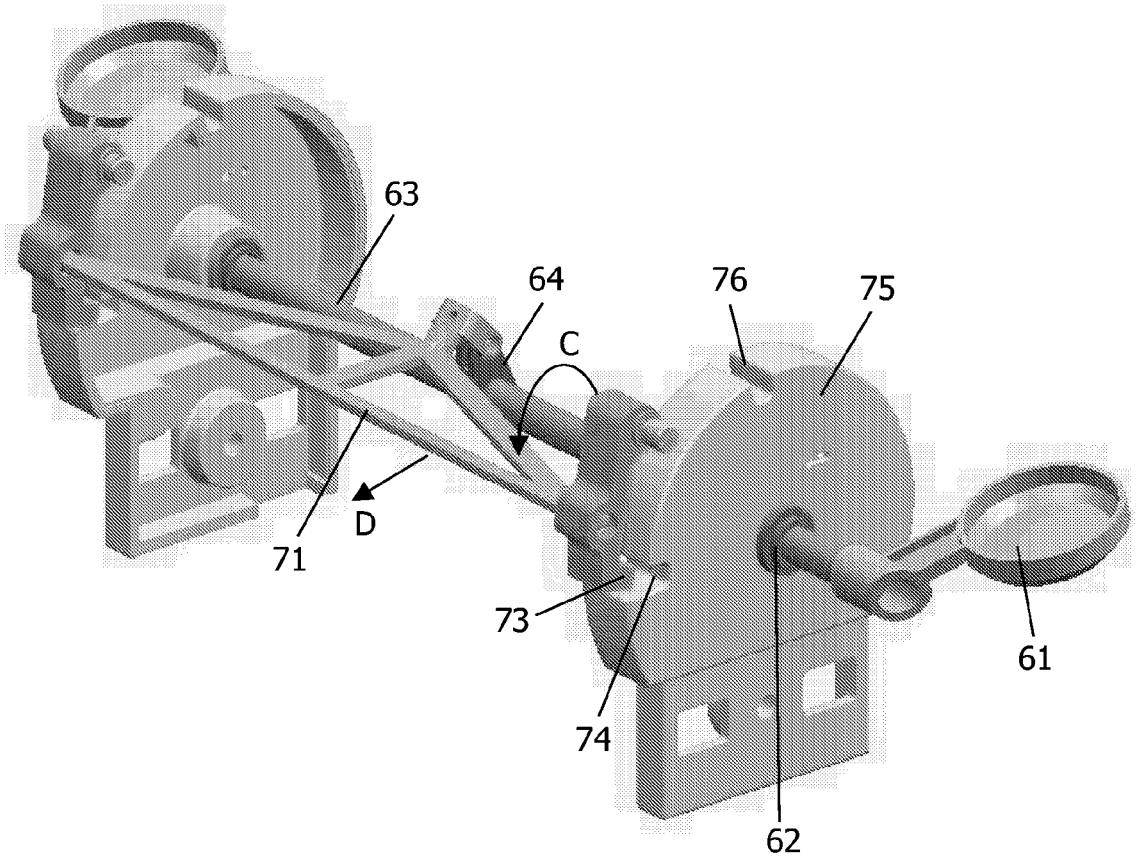
Figure 9:
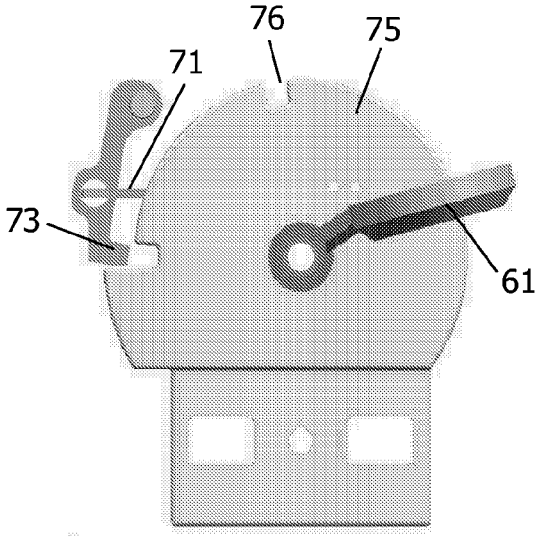
Figure 10:
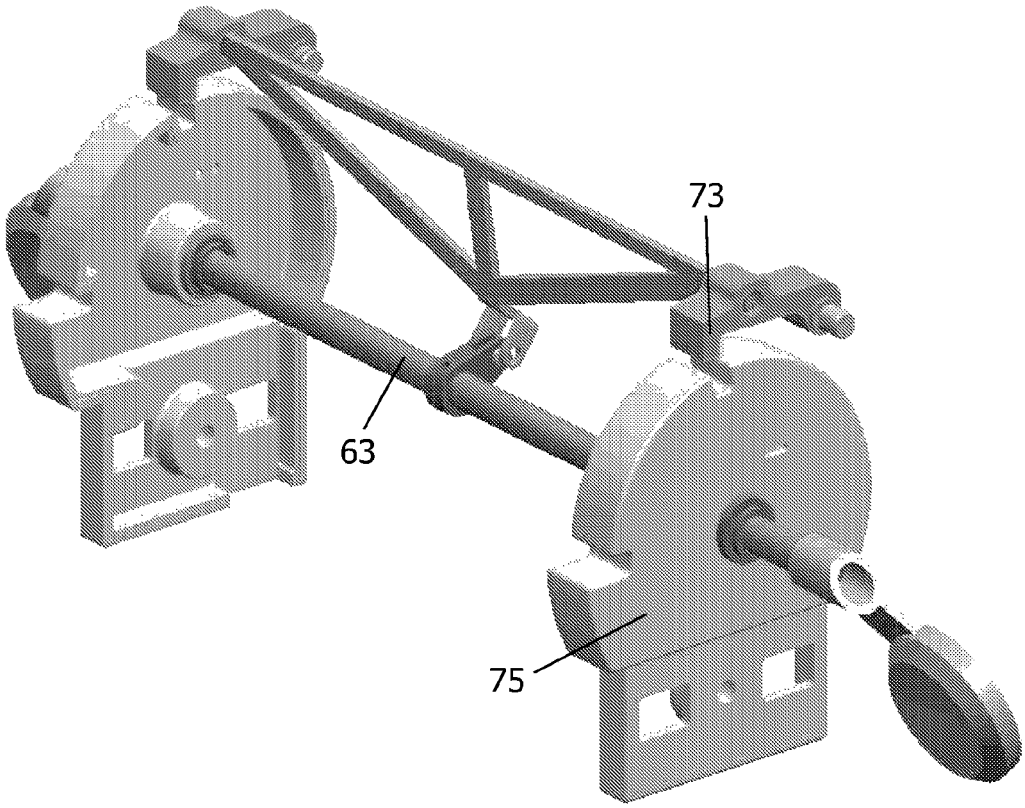
Figure 11A:
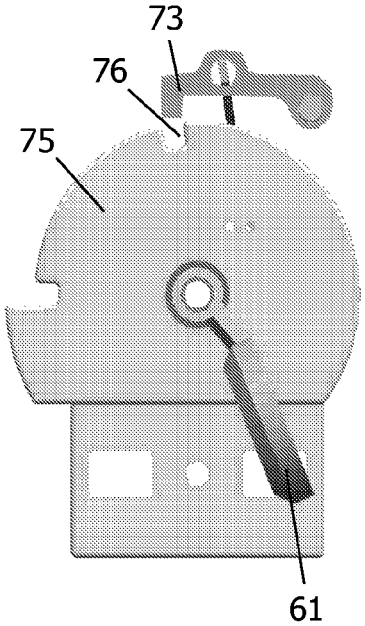
Figure 11B:
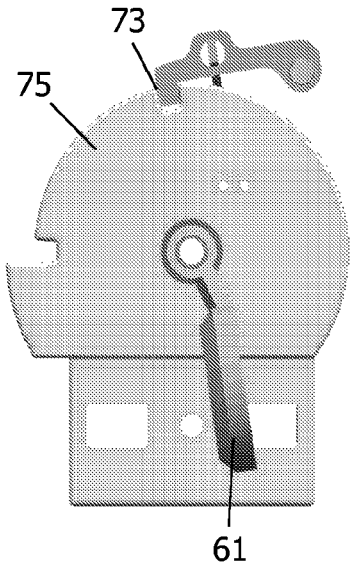
Figure 12:
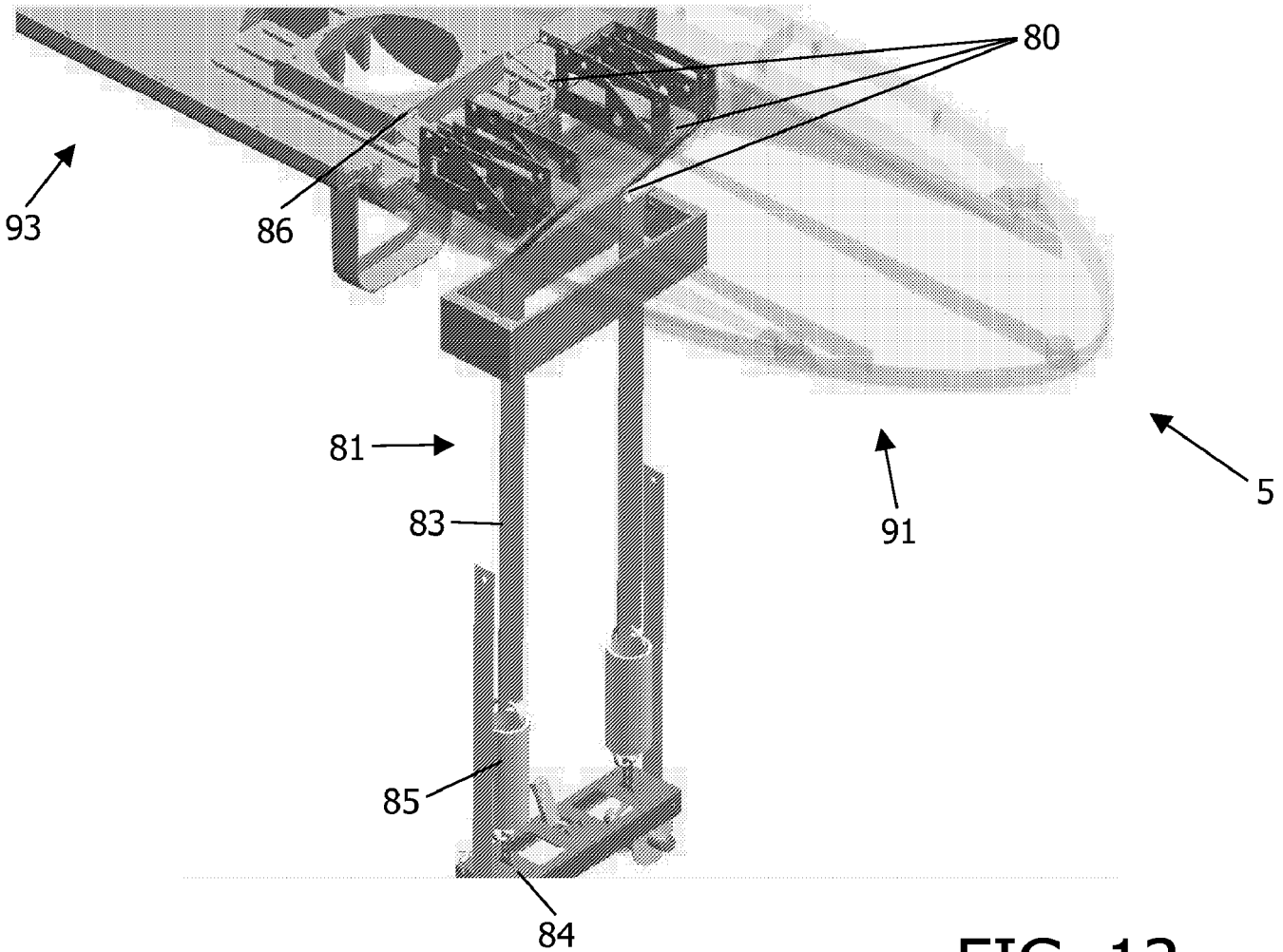
Figure 13:
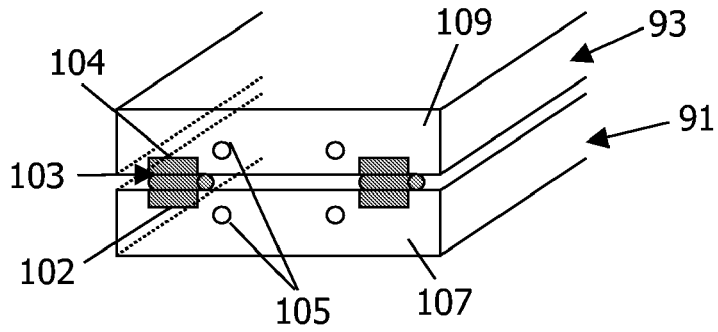
Figure 14:
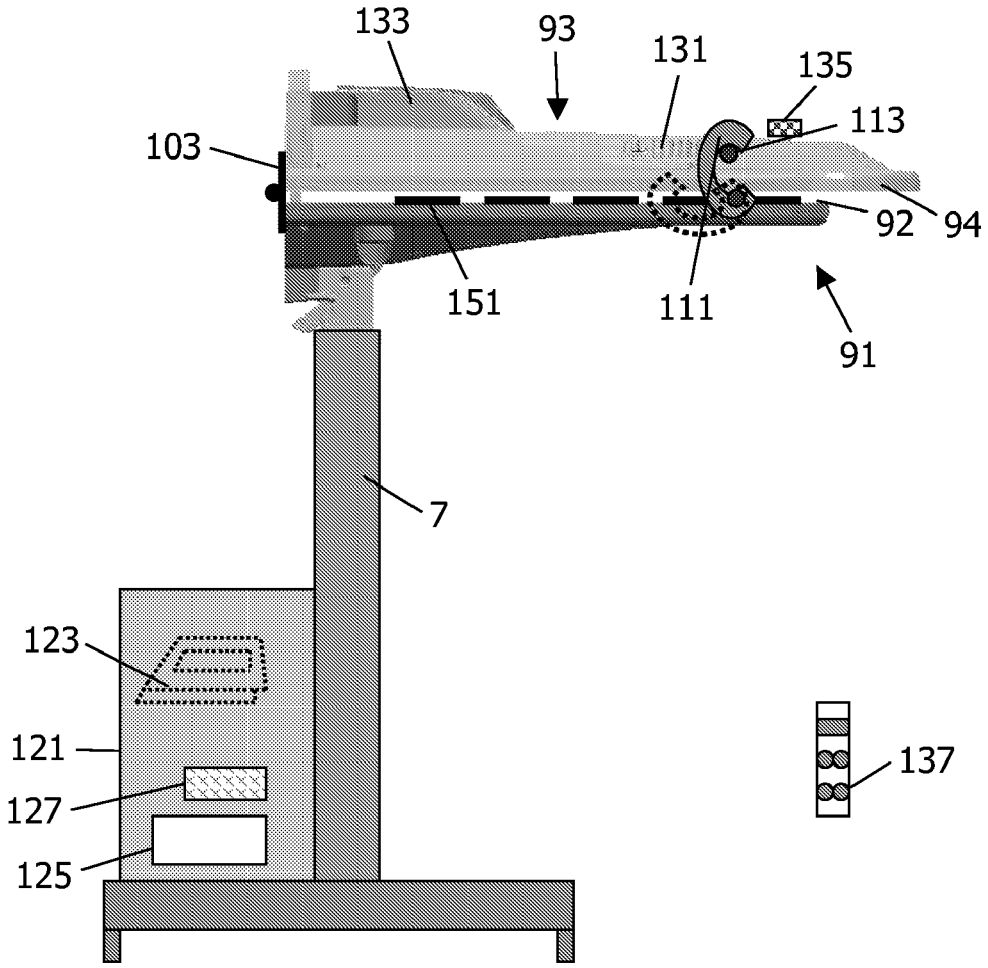
Figure 15A:
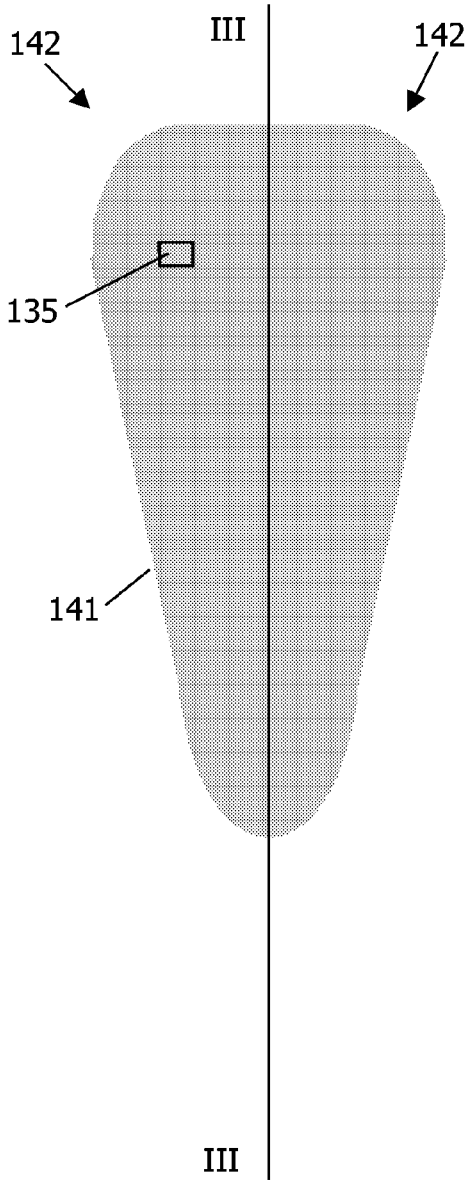
Figure 15B:
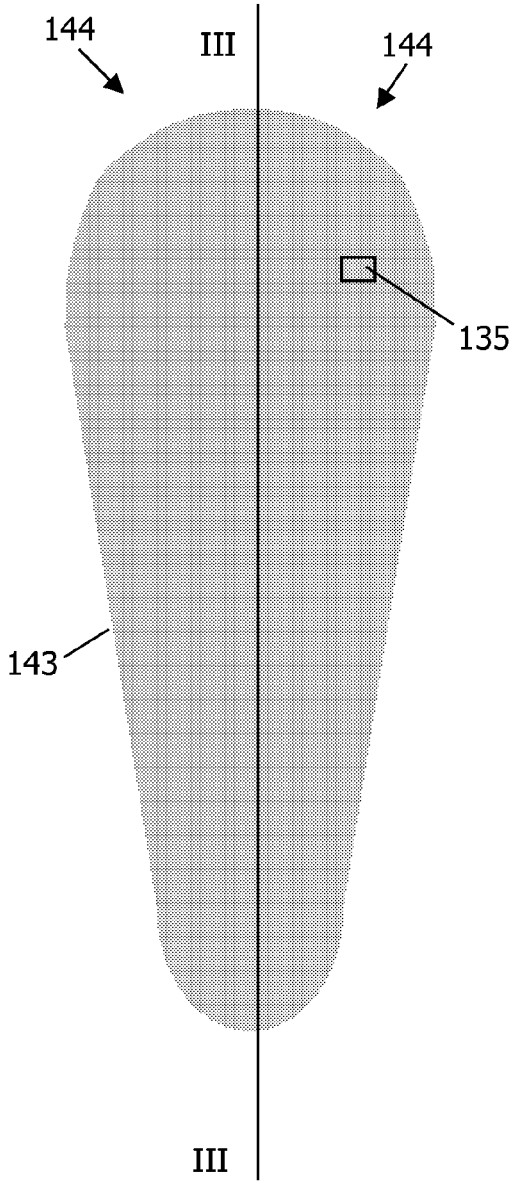
Figure 16:
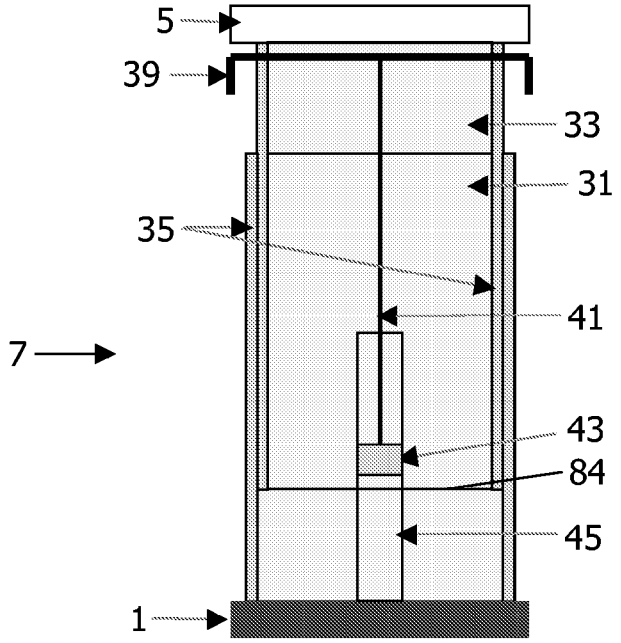
Figure 17:
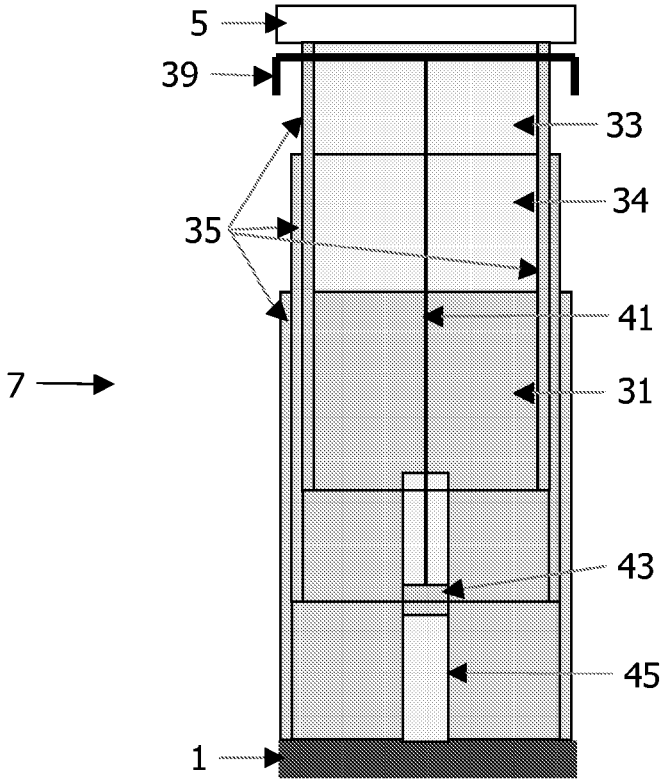
Figure 18:
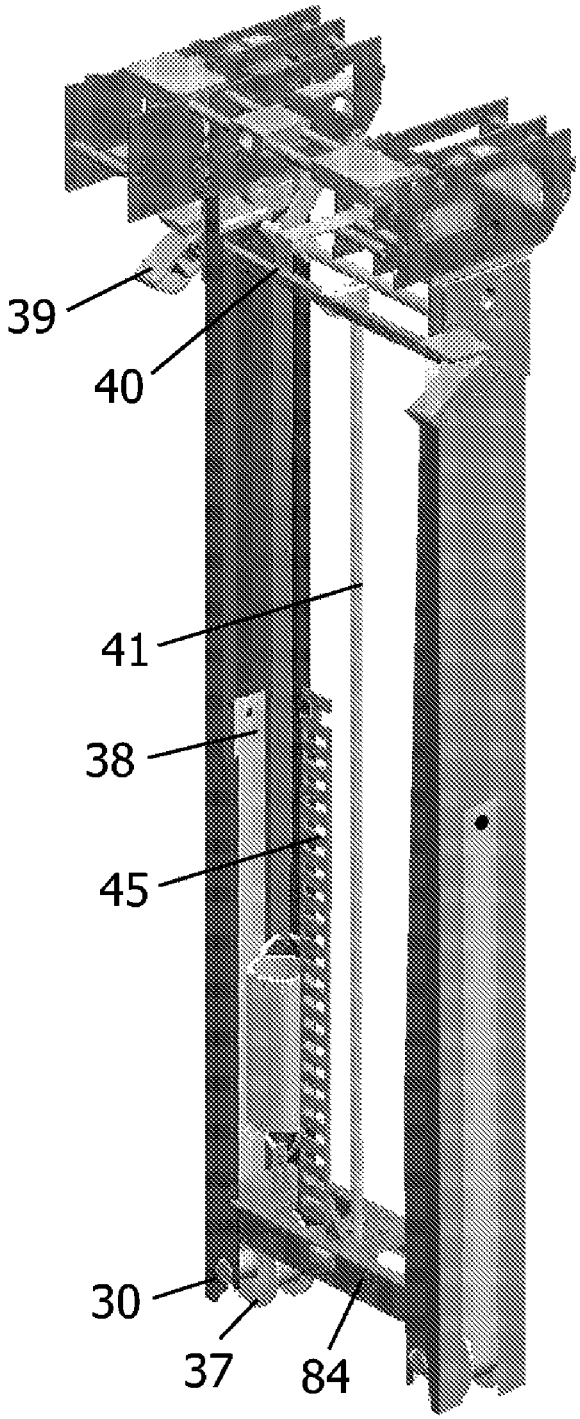
Figure 19:
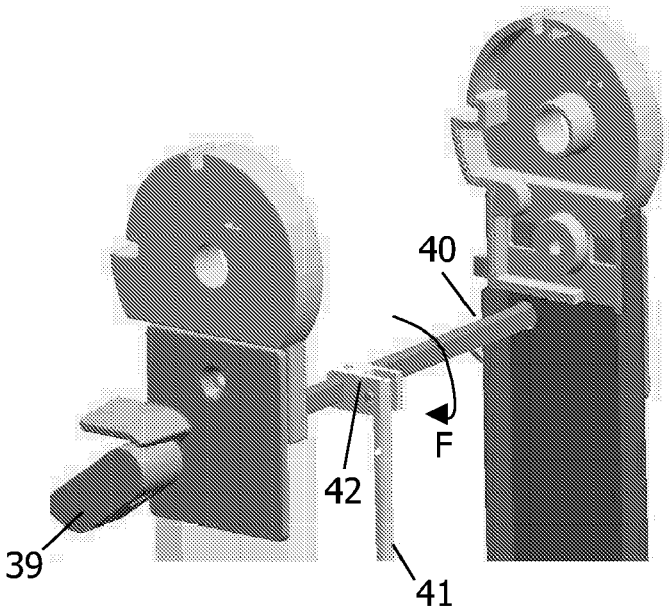
Figure 20:
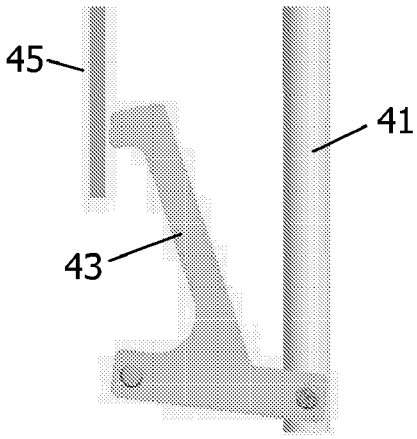
Figure 21B:
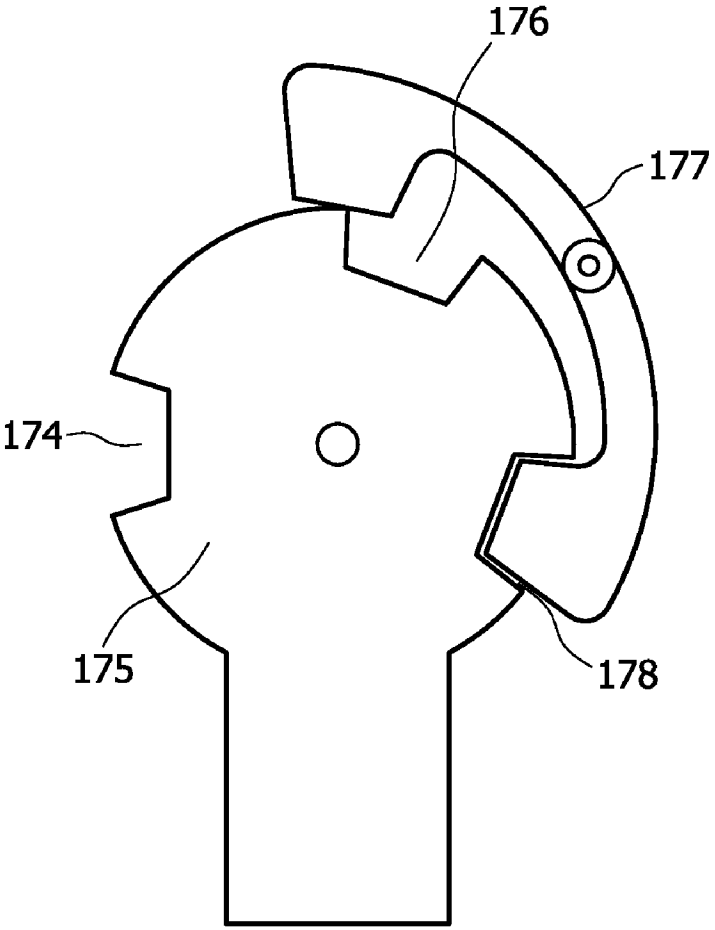
Figure 21A:
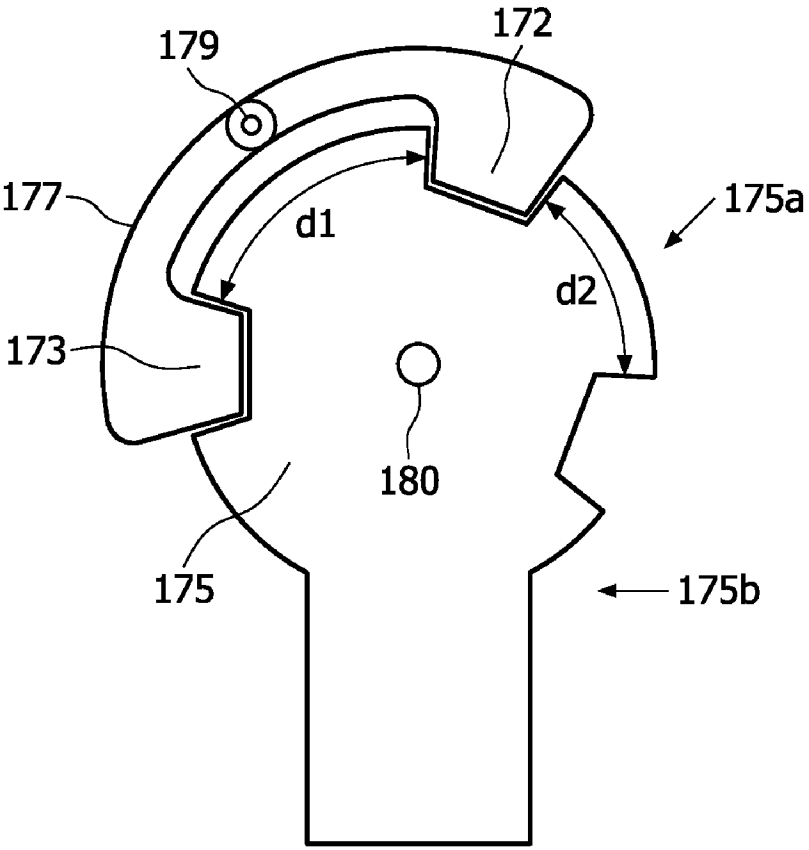
Figure 22B:
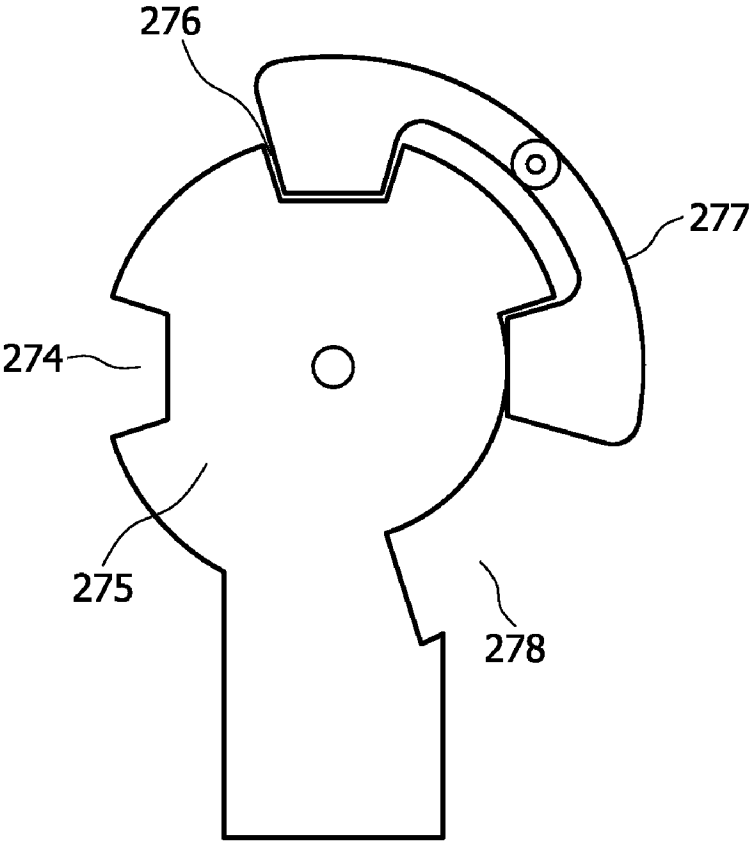
Figure 22A:
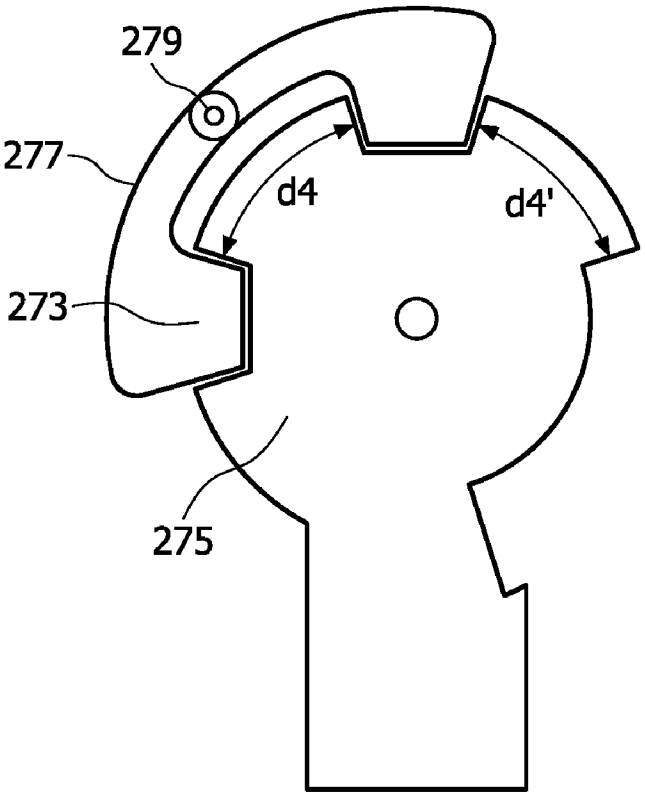
Figure 23:
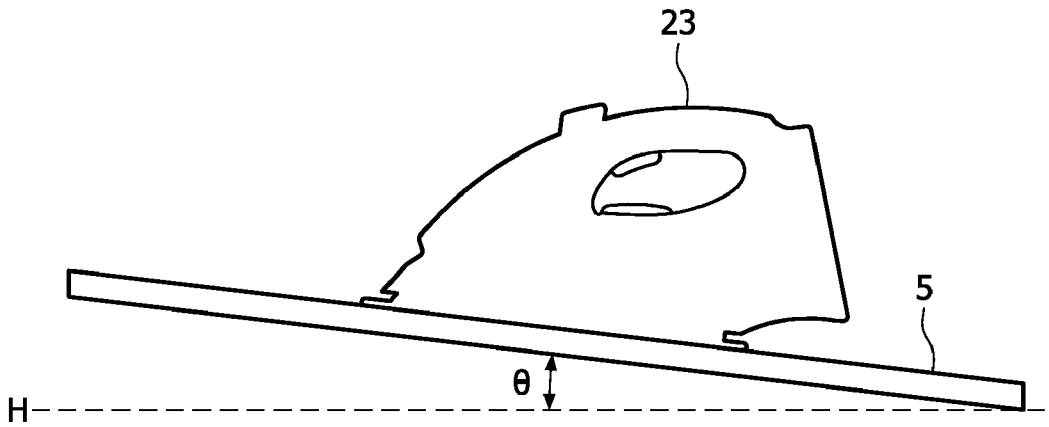
Figure 24:
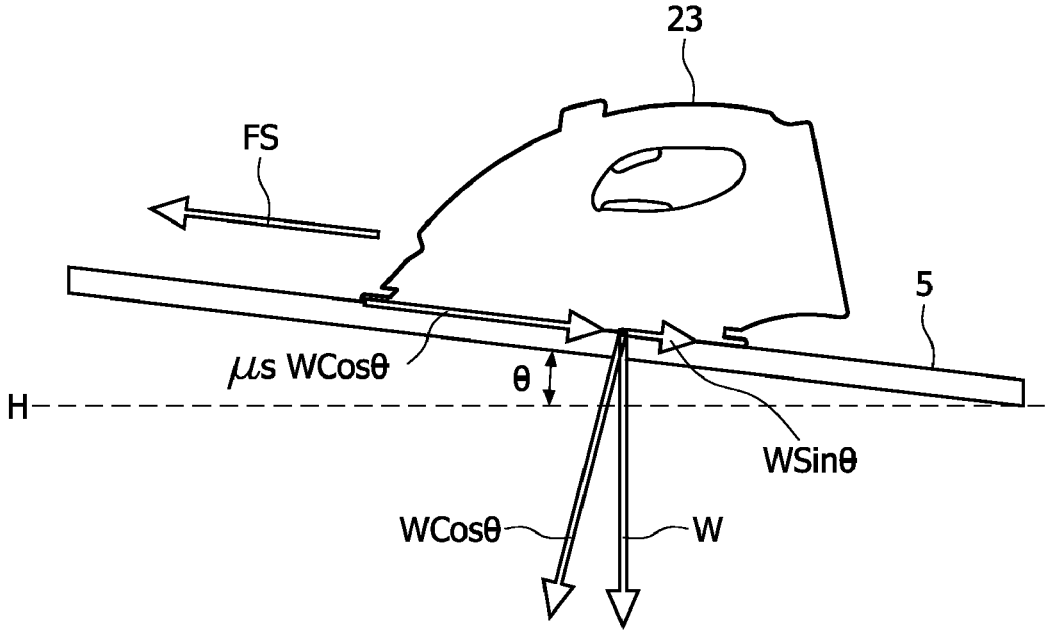
Figure 25:
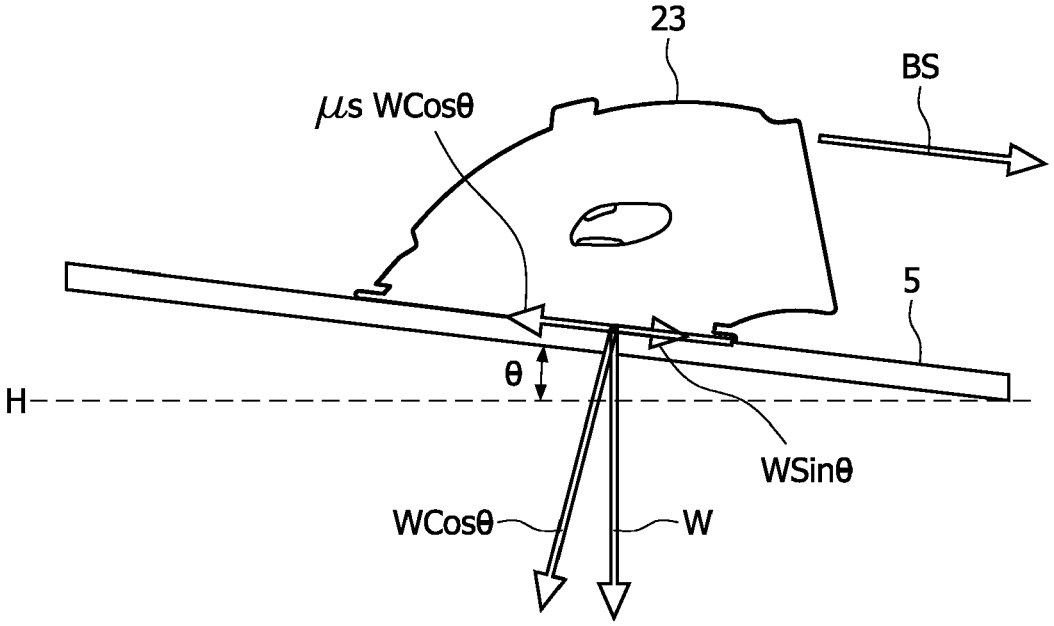
Figure 26:
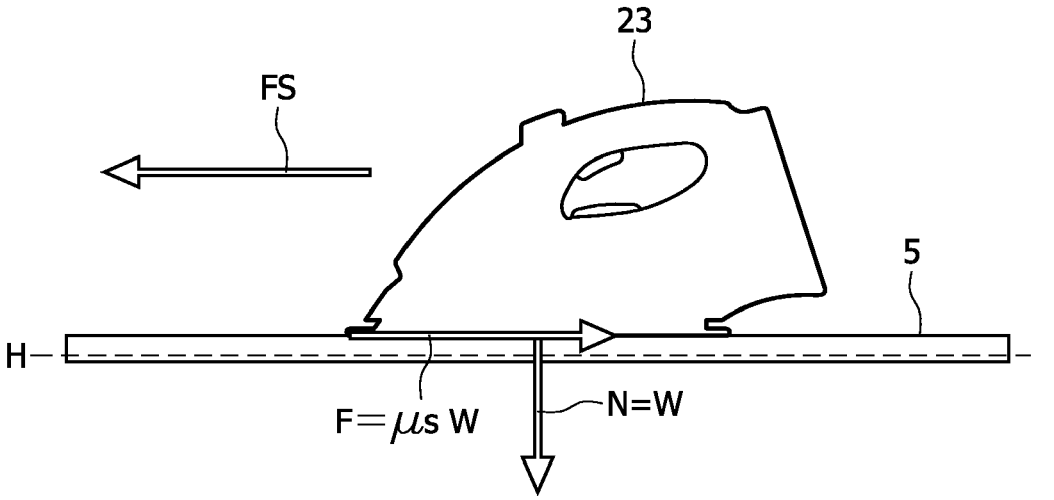

The invention will now be described by way of example with reference to the accompanying drawings. In principle all aspects can be combined. In the figures the same numbers are being used for the same or equivalent features, in which:

FIG. 1 schematically depicts a first embodiment of an ironing board according to the invention with the body in a substantially vertical position, FIG. 2 schematically shows the ironing board of FIG. 1 with the body in a substantially horizontal position, FIG. 3 schematically shows an adjustment mechanism for the ironing board according to the invention with the body in a substantially vertical position, FIG. 4 schematically shows the adjustment mechanism for the ironing board of FIG. 3 with the body in a substantially horizontal position, FIG. 5 schematically shows an embodiment of a detail of the adjustment mechanism, FIG. 6*a* schematically depicts a second embodiment of the ironing board according to the invention, FIG. 6*b* schematically depicts the embodiment of FIG. 6*a* with the body in a substantially vertical position, FIG. 6*c* schematically depicts the embodiment of FIG. 6*a* in a folded position, FIG. 7 schematically shows a first embodiment of a tilting means for the ironing board according to the invention, FIG. 8 schematically shows a detail of the tilting means of FIG. 7 in perspective, FIG. 9 schematically shows a side view of a detail of FIG. 8, FIG. 10 schematically shows a detail of the tilting means of FIG. 7 in perspective in another position, FIG. 11*a* schematically shows a side view of a detail of FIG. 10 in a first position, FIG. 11*b* schematically shows a side view of a detail of FIG. 10 with the protrusion in a second position, FIG. 12 schematically shows a detail of a third embodiment of an ironing board according to the invention, FIG. 13 schematically shows an air guiding means for the ironing board according to the invention, FIG. 14 schematically shows an embodiment of the ironing board according to the invention in a pressing mode, FIG. 15*a* schematically depicts a first embodiment of a torso-shaped body according to the invention, FIG. 15*b* schematically depicts a second embodiment of a torso-shaped body according to the invention, FIG. 16 schematically shows an embodiment of the height adjustment means of an ironing board according to the invention, FIG. 17 schematically shows an alternative embodiment of the height adjustment means of an ironing board according to the invention, FIG. 18 schematically shows an embodiment of a weight compensation means as part of an embodiment of a height adjustment means for an ironing board according to the invention, FIG. 19 schematically shows an enlarged detail of the height adjustment means of FIG. 18, FIG. 20 schematically shows another enlarged detail of the height adjustment means of FIG. 18, FIGS. 21*a* and 21*b* schematically show a detail of a second embodiment of the tilting means for the ironing board according to the invention in side view, FIGS. 22*a* and 22*b* schematically show a detail of a third embodiment of the tilting means for the ironing board according to the invention in side view, FIG. 23 schematically shows a detail of the ironing board according to the invention with the body in an inclined position, FIG. 24 depicts a force diagram of a forward stroke of the iron on the body of FIG. 23, FIG. 25 depicts a force diagram of a backward stroke of the iron on the body of FIG. 23 and FIG. 26 depicts a force diagram of a forward stroke of the iron on a horizontal body.

The figures will now be described in detail and reference is being made to the numbers in the figures. In FIG. 1 an embodiment of an ironing board 2 having a body 5, a base 1 and a column 7 is depicted. The body 5 is in a substantially vertical position and the base 1 has a length L1. In FIG. 2 the body 5 is in a substantially horizontal position and the base 1 has a length L2, which is larger than L1. FIGS. 1 and 2 together illustrate the relation between the position of the body 5 with a work surface 6 and the length of the base 1. The length of the base 1 is the distance between the contact points (4*a* and 4*b*) with the floor during use. The base 1 comprises a first base part 1*a* and a second base part 1*b*. The first base part 1*a* is attached to the column 7 and the second base part is slide able along the first base part 1*a*.

In FIG. 3 an adjustment mechanism 9 is shown with the body 5 in a substantially vertical position. The body 5 (not shown in FIG. 3) is connected to a rod 10 that enables the body to be tilted along a tilting axis T-T. As the body 5 is tilted along tilting axis T-T towards the horizontal position (as shown in FIG. 4), the rod 10 begins to turn. This brings about a rotational movement of a crown wheel 15 connected to the rod 10. This crown wheel as a result rotates a further crown wheel 13 connected to the vertical shaft 11 serving as a rotation axis. Thus the vertical shaft 11 is rotated counter clockwise. This rotation of the shaft 11 moves a base lever 17 in a slit 19 and consequently the base 1 slides out as illustrated by arrow A. The base is preferably equipped with sliding means, e.g. wheels 21. The result of this movement is shown in FIG. 4.

FIG. 5 schematically shows an example of the shaft 11 comprising a first telescopic part 12 and a second telescopic part 14, which are not rotatable relative to each other because they have a non-circular cross-section. Such a shaft may be used in an embodiment of the invention where the retractable/elongateable base feature is combined with height adjustment. A shaft comprising telescopic parts allows the distance between body and base to be varied.

In FIG. 6*a* the second embodiment of the ironing board 2 according to the invention is depicted comprising a base 1 and a body 5 with a work surface 6, the body having a first longitudinal axis I-I. The ironing board further has a column 7, having a second longitudinal axis II-II. The tilting axis T-T extends substantially perpendicularly to both the first axis and the second axis. FIGS. 6*a* and 6*b* illustrate two positions that can be obtained by tilting the board with the body having a stretched-like state.

In FIGS. 7 to 11*b* and FIGS. 21*a*, 21*b* and 22*a*, 22*b* details of the tilting means are depicted.

In FIG. 7 the first embodiment of the tilting means for the ironing board according to the invention is depicted, it is shown that the body 5 (shown in part) of the ironing board is rotatably connected to an axle 63. The axle 63 in this example is an embodiment of the tilting axis T-T (as shown in FIG. 6*a*). The embodiment comprises a first button 61, connected to the axle 63. The axle 63 is connected to a triangle 71 via a first connector 64. The triangle 71 is connected to a clamp protrusion 73, which is arranged for cooperation with a pivot plate 75. The pivot plate 75 has a first slot 74 and a second slot 76 (as shown in FIG. 8).

The tiling is now described with reference to the figures. The starting point of the description is the body in a substantial horizontal position as depicted in FIG. 6*a*. If the user pushes the first button 61 in the direction of the body, the axle 63 rotates as illustrated by arrow C in FIG. 7. Hence, the triangle 71, coupled to the axle 63 via the first connector 64, is pushed in the direction of arrow D (see also FIGS. 8 and 9). As a result the clamp protrusion 73 is released from the first slot 74 located in the plate pivot 75. If the user, simultaneously with pushing the first button 61, exerts a force in the direction of an arrow E (see FIG. 6), the body 5 rotates and the clamp protrusion 73 slides along the plate pivot 75 to the next available slot, in this case the second slot 76 (see FIGS. 10 and 11*a*). If the user releases the first button 61, the clamp protrusion 73 fits in the second slot 76 (see FIG. 11*b*). Because the body 5 is connected to the axle 63 the result is that the body 5 is tilted along the rotation axle 63 to a substantially vertical position; in this case about 81 degrees relative to the horizontal plane. This is illustrated in FIG. 6*b*.

In the second embodiment of the ironing board according to the invention the body 5 (see FIG. 6*b*) has a first part 91 having a first work surface 92 and a second part 93 having a second work surface 94, the first and second parts being connected by a hinge 103 serving as folding means. The first part 91 may be provided with a support element 101 for supporting the second part (see FIG. 6*a*). A first part of the hinge 102 is secured to the first part of the body 91 and a second part of the hinge 104 is secured to the second part 93 of the body (see FIG. 13).

The folding of the body of the ironing board will now be explained. The starting point of the description is the body in a substantial vertical position as depicted in FIG. 6*b*.

If the user pushes the first button (61) in the direction of the body, the clamp protrusion 73 is released from the second slot 76 in the plate pivot 75 (see FIG. 11*a*). If the user, simultaneously with pushing the first button 61, exerts a force in the direction of the arrow E on the second part 93 of the body, this second part is folded towards the first part. The first work surface 92 and the second work surface 94 now face each other. This is illustrated in FIG. 6*c*. In this mode the ironing board according to the invention can be stored easily and in a compact manner.

In order to prevent the second part 93 of the body from slamming down on the first part 91 and to accompany the folding process, a resilient element 81 is provided. In FIG. 12 an embodiment of the resilient element 81 is shown. In this embodiment the resilient element comprises a strap 83 fixed to a spring 85. One end of the strap 86 is connected to the second part 93 of the body and the other end of the strap is connected to the spring 85. The spring is secured to the first bottom part of the column 84. The first bottom part 84 is part of a moveable frame 33 of the column 7 (shown in FIG. 16 and explained later).

The shifting of the position of the body 5 in the second embodiment from substantially horizontal (stretched state like in FIG. 6*a*) to substantially vertical (stretched state like in FIG. 6*b*) might result in unwanted folding of the body. In order for the tilting of the body to prevail over premature folding, the resilient element 81 (see FIG. 12) is selected and constructed in such a way that the resilient force is stronger than the force needed to tilt the body, thus keeping the parts together while tilting the body 5. In FIG. 12 it can be seen that the course of the resilient element 81 leads through the column (not shown), through the first part of the body 91 and ends in the second part of the body 93. The strap is secured to the second part 93 at the location indicated by number 86 (FIG. 12). Depending on the weight of the body a skilled person can select the force of the resilient element. This could be the force of the spring 85. The strap and the spring may be substituted by for instance an elastic band (not shown). In that case the force of the elastic band can be selected by the skilled person. A guiding means 80 guides the course of the resilient element. An example of the guiding means is a roller known per se.

To keep the first part 91 of the body and the second part 93 of the body in a stretched state during tilting, alternatively a fixation means (not shown) might be provided.

This fixation means may be a hinge or spring-loaded hinge, known per se, which has two stable positions e.g. open position and closed position.

Alternatively, the fixation means may comprise a protrusion secured to the first part of the body close to the first part of the hinge (102, see FIG. 13) cooperating with a receiving means secured to the second part of the body close to the second part of the hinge 104 (FIG. 13). The cooperation is done in a way known per se, so the first and second part of the body are fixed in their stretched state. The protrusion could be a hook and the receiving means a socket, these are known per se. In such an embodiment the user would have to release the hook from the socket before the body can be folded. In practice it would function as locking/unlocking means between the parts of the body.

In FIG. 14 an embodiment of the board according to the invention in a pressing mode is depicted. This embodiment comprises a hook 111 fixed to the first part 91 of the body and a body protrusion 113 secured to the second part 93 of the body. This could also be the other way around. The body protrusion 113 serves as a receiving element. The skilled person can select alternative known hook-shaped elements and known receiving elements and fix them to the first part 91 and second part 93 of the body respectively in such a way that the elements can cooperate. A touch button 135 serves as a control unit for an electrical unit (not shown). The electrical unit is arranged for activating the fan 133.

A way of pressing an article using an ironing board according to the invention will now be described. The body in a horizontal position (ironing mode) (FIG. 6*a*) is taken as a starting point. An article 151 is placed on the first work surface 92 of the first part 91 of the body. The second part 93 of the body is folded towards the first work surface 92. The first part 91 of the body will remain latched on the pivot plate 75 (in the horizontal position). In this way the first 92 and second work surface 94 are facing each other and at least a portion of the article 151 is located in between. Now the parts 91, 93 are clamped together. This is done by moving the hook 111 around the body protrusion 113. If the touch button 135 is pushed, the fan 133 is activated resulting in an air stream flowing through the second work surface 94 of the second part of the body and through (part of) the article 151. A board heater (if present, not shown) may be activated to provide heat during the pressing operation.

In an embodiment according to the invention the control unit for activating the fan 133 comprises a remote control 137.

In FIG. 14 it is furthermore shown that an embodiment of the ironing board according to the invention may be provided with a chamber 121 or e.g. a drawer for accommodating appliances, for instance an iron 123 and if present, a garment steamer. In this way the board has means for storing the iron and/or garment steamer.

In an embodiment of an ironing board according to the invention the ironing board is arranged for housing at least either a water tank 125 or a boiler 127 or a power supply (FIG. 14). The boiler is provided with a hose, which is connectable to an iron having an inlet (not shown). The water tank 125 is arranged for providing water to the boiler in a manner known per se. In this way steam can be generated and supplied to the iron. The iron can thus function as a steam iron. The iron can thus cooperate with the ironing board.

FIG. 15*a* schematically depicts a first embodiment of a torso-shaped body according to the invention, where the work surface has a contour 141, which corresponds to the contour of a longitudinal section of a torso.

FIG. 15*b* schematically depicts a second variant of a torso-shaped body according to the invention having a contour 143.

The torso-shape may be symmetrical relative to an axis III-III.

In an embodiment of the ironing board according to the invention, the board has a refreshing mode. In this mode the user can refresh articles by hanging them over the body 5, the body being in a substantially vertical position (see FIG. 6*b*).

The article can be for instance a jacket, a blazer, a blouse or a shirt. The article may be buttoned and thus closed at the, what is usually called, front side of the article. In this way the shoulder parts hang over the shoulder (for example: 142 in FIG. 15*a*, or, alternatively, 144 in FIG. 15*b*) of the body 5. A non-button article like a dress or a sweater may be hung over the body in such a way that the shoulder straps or shoulder parts rest on the shoulders of the body. In both descriptions the body is dressed with the article. Alternatively, the article may hang on a hanger and the hanger is connected to the body. The user activates the electrical unit to start the fan 133. The fan 133 produces an air stream. The activation is done using the control unit 135. The control unit may for instance be located at any place at the back of the body so that the user can easily reach it. Alternatively, the control unit comprises a remote control 137. The fan activation can also be done from a garment steamer (if present). In this case, garment refreshing is accelerated with the use of steam from the garment steamer, and assisted with air (which could be warmed with a heater) from the board.

In an embodiment according to the invention the air flows through a permeable work surface. In case the body has multiple parts, the air is guided via air guiding means for guiding air, mobilised during use by the fan 131, from one part of the body to the another part of the body and vice versa.

The air guiding means comprises a first wall portion of the first part of the body 107 (FIG. 13), which first wall portion is located near the folding means 103 and a second wall portion of the second part of the body 109, which second wall portion is located near the folding means and which first and second wall portions are provided with corresponding openings 105.

In an alternative embodiment the body is equipped with vents 131 (FIG. 14), the vents 131 are opened and the air stream is mainly blown out of the vents located at opposite sides of the body. Now an air stream flows towards the sleeves and the upper part of the article. In this way the armpit region, known as a sweat area, is especially refreshed.

In an embodiment of the ironing board 2 according to the invention depicted in FIG. 16, the ironing board comprises a height adjustment means to adjust the distance of the body 5 relative to the base 1. In FIG. 16 a schematic embodiment of the height adjustment means is depicted showing the column 7 equipped with a stationary frame 31 secured to the base 1 and a moveable frame 33 secured to the body 5. The stationary frame 31 has a guiding means 35 for guiding the movable frame 33. In FIG. 17 an alternative embodiment of the height adjustment means is shown. In this embodiment the ironing board comprises a second movable frame 34. The second movable frame 34 moves relative to the stationary frame 31 and the movable frame 33 moves relative to the second movable frame 34.

The height adjustment means is shown in more detail in FIGS. 18, 19 and 20.

In these figures is depicted that a second button 39 is connected to a shaft 40. The shaft 40 is connected to a strip lift 41 via a second connector 42 (FIG. 19). A lever lift 43 (FIG. 20) is secured to the strip lift 41 and cooperates with an index plate 45.

To adjust the height the user pushes the second button 39 towards the body. In this way the shaft 40 is rotated in the direction of the arrow F (see FIG. 19). As a result, the strip lift 41, connected to the shaft 40 via the second connector 42, is moved down. As a result, the lever lift 43 is released (unlocked) from the index plate 45 (or alternatively a gear train) (see FIG. 20). The user may now (while pushing the second button 39) pull the body 5 up or push it down because the movable frame 33 can move freely using the guiding means 35 on the stationary frame 31. To lock the body in a desired height the user releases the second button 39 and the lever lift 43, serving as stopper means, slides in the nearest opening in the index plate 45.

In order to facilitate the height adjustment so that the used does not have to apply a force to lift the weight of the body and the frame connected to it, an ironing board according to the invention is preferably equipped with means of exerting a repelling force on the body. Such a force is a force on the body directed away from the base. This force may be provided by electrical, magnetic, hydraulic, pneumatic or mechanical means.

In an embodiment according to the invention the weight of the body 5 is compensated during height adjustment by a constant-force spring 37 (see FIG. 18). The constant-force spring 37 is at one end 38 fixed, by means of common fixing means, such as a screw or a mounting bridge, to the stationary frame 31 (visualised in FIG. 16) and the other end connected to the movable frame 33 (visualised in FIG. 16). The bottom 84 (shown in FIG. 16) of the movable frame 33 sits on the fastening means 30 of the constant force spring 37. Because the body 5 (visualised in FIG. 16) is secured to the movable frame 33, the weight of both the body 5 and the movable frame 33 is compensated by the constant-force spring.

In FIGS. 21*a* and 21*b* a side view of a detail of the second embodiment of the tilting means for the ironing board according to the invention is schematically depicted. A pivot plate 175 has a circular shaped locking piece 175*a* having a pivot plate opening 180 located in the center. The pivot plate opening 180 is arranged for receiving the already mentioned axle (not shown here). The pivot plate 175 further has a rectangular piece 175*b* arranged for securing the pivot plate to the already mentioned column (not shown here).

In this embodiment the tilting means comprises the axle (not shown) as the first unit being fixed to the body and the pivot plate 175 as the second unit being fixed to the column. The axle and the opening 180 in the pivot plate 175 being complementarily shaped for mutual cooperation and the already mentioned first and the second units being rotatably coupled to each other.

The pivot plate 175 has a first slot 174, a second slot 176 and a third slot 178. In comparison with the first embodiment an additional slot is provided. A clamp 177 comprises a first protrusion 173 and a second protrusion 172 and a clamp opening 179 arranged for receiving and cooperation with the already mentioned triangle (not shown here).

In this embodiment the locking means comprises the pivot plate 175 comprising three slots 174, 176 and 178 and the clamp 177 comprising two protrusions 173 and 172. The protrusions shown are trapezium shaped and fit into the also trapezium shaped slots. The skilled person can select any suitable shape as long as the protrusion fits into the slot it has to cooperate with and locks the already mentioned body in the predetermined position.

The locking means may also be constructed in an inverse manner, wherein the pivot plate comprises plate protrusions and the clamp comprises clamp receiving means such as clamp slots arranged for receiving the plate protrusions.

In FIG. 21*a* the situation of the ironing mode is illustrated, wherein the body is in horizontal position, the usual ironing position. Protrusions 173 and 172 fit into slots 174 and 176 respectively; this way the body is substantially free from rotational play. The additional protrusion fitting into the slot provides additional stabilisation of the position of the body compared to the situation illustrated in FIGS. 8, 9.

As explained above, if the user, simultaneously with pushing the first button 61 (not shown), exerts a force in the direction of an arrow E (see FIG. 6), the body rotates and the clamp protrusions 173 and 172 slide along the pivot plate 175 to the next available slot.

In the example of FIGS. 21*a* and 21*b* the distances d1 and d2 between two adjoining slots are unequal. As a result only second protrusion 172 fits into the next available slot, this is the third slot 178 (see FIG. 21*b*). In FIG. 21*b* the body is rotated upward in the refreshing mode of the system, the protrusion 172 is in slot 178, preventing the table from tilting further towards the user.

In FIGS. 22*a* en 22*b* a side view of a detail of the third embodiment of the tilting means for the ironing board according to the invention is schematically depicted. A pivot plate 275 has a first slot 274, a second slot 276 and a third slot 278. A clamp 277 has a first protrusion 273 and a second protrusion 272.

FIG. 22*a* corresponds to the horizontal position of the body (ironing mode). FIG. 22*b* corresponds to the position of the body in upward position of the body (refreshing mode of the system).

In FIGS. 22*a* and 22*b* the distances d4 and d4' between adjoining slots are equal. The result is that if the user, simultaneously with pushing the first button 61 (not shown), exerts a force in the direction of an arrow E (see FIG. 6), the body 5 (not shown) rotates and the clamp protrusions 273 and 272 slide along the pivot plate 275 to both fit into the next available slots 276 and 278. With protrusion 273 now fitting into slot 276 and protrusion 272 fitting into elongated protrusion 278 the body is fixed in the substantially vertical position or almost vertical, in this case about 81 degrees relative to the horizontal plane. The user may press iron to the body for ironing in a non-horizontal mode instance for vertical ironing. For moving the body horizontally again protrusions 273 and 272 have to be released from their corresponding slots. Slots located at positions suitable for ironing using a body tilted 1 to 30 degrees relative to the horizontal plane may be provided.

FIG. 23 schematically shows the body 5 in an inclined position at an angle of θ with respect to the horizontal plane H. The iron 23 is located at the work surface of the body 5.

For the following explanation the wording is such that the body is inclined in the upward direction with respect to the movement of the iron tip.

FIGS. 24 and 25 schematically depict a force diagram related to an inclined body during the forward (direction indicated with arrow FS) and backward stroke (arrow BS), respectively. The force diagram related to a horizontal body is depicted in FIG. 26. The weight of the iron is assumed to be W Newton and the kinematic coefficient of friction as μs when moving along the work surface of the body. The force calculations are described hereinafter.

Resolving the weight of the iron W Newton acting in the downward direction gives:

the static shear force Fs along the board in the downward direction as: $Fs=W \sin\theta$ the normal force N acting perpendicular to the ironing board as: $N=W \cos\theta$ Thus, the kinematic frictional force Fk of the iron is: $Fk=\mu s\, N=\mu s\, W \cos\theta$ The direction of the force depends on the direction of movement of the iron. When the iron moves up the kinematic frictional force acts down and when the iron moves down the kinematic frictional force acts up.

$$\text{Iron tip moves up:Total Shear Force}=\mu s W \cos\theta+W \sin\theta$$

$$\text{Iron tip moves down:Total Shear Force}=\mu s W \cos\theta-W \sin\theta$$

For a horizontal body the shear force is the same for both forward as well as backward direction and is obtained by equating θ=0 in the above equations.

Horizontal Body:

Angle θ=0° relative to the horizontale plane and assuming μs=1,

Total Shear Force (hor)=μs W=W

Inclined Body:

Angle θ=10° relative to the horizontale plane and assuming μs=1, and iron tip moves up:

$$\text{Total Shear Force(up)}=\mu s W \cos 10+W \sin 10=1.16W>W$$

The total Shear Force (up) is larger than the Total Shear Force (hor)

and iron tip moves down:

$$\text{Total Shear Force(down)}=\mu s W \cos 10-W \sin 10=0.811W<W$$

The total Shear Force (down) is smaller than the Total Shear Force (hor)

Good results have been obtained by an angle θ in a range of 10-30 degrees relative to the horizontal plane. This may be obtained by providing an slot or slots at dedicated positions on the pivot plate resulting in θ of about 10 degrees, about 20 degrees and/or than about 30 degrees relative to the horizontal plane.

It is noted that numerous embodiments not depicted in the drawings are implied in the invention as described.

The invention claimed is:

1. An ironing board comprising a base, a body with a work surface, said body having a first longitudinal axis and being connected to the base, the ironing board further comprising a column extending between the body and the base and having a second longitudinal axis, and tilting means for tilting the body about a tilting axis extending substantially perpendicularly to both the first axis and the second axis characterized in that the body comprises a first part having a first work surface and a second part having a second work surface, the first and second parts being connected by folding means, the first part being secured to the column.

2. The ironing board as claimed in claim 1, characterized in that the tilting means comprises a first unit fixed to the body and a second unit fixed to the column, the first unit and second unit being complementarily shaped for mutual cooperation and the first and the second units being rotatably coupled to each other.

3. The ironing board as claimed in claim 2, characterized in that one of the first and second units comprises an axle and the other of the first and second units comprises a notch, the axle and the notch being arranged to be rotatable relative to each other.

4. The ironing board as claimed in claim 1, characterized in that the ironing board comprises a weight balance means for compensating a difference in weight between segments of the body extending at opposite sides of the tilting axis.

5. The ironing board as claimed in claim 4, characterized in that the weight balance means comprises a resilient element extending between the body and the column, one end of the resilient element being connected to the body and the other end being connected to the column.

6. The ironing board as claimed in claim 5, characterized in that the column is provided with guiding means for guiding the resilient element.

7. The ironing board as claimed in claim 6, characterized in that the resilient element comprises a strap attached to a spring.

8. The ironing board as claimed in claim 1, characterized in that the board comprises a predetermined position between 0-85 degrees relative to the horizontal plane.

9. The ironing board as claimed in claim 8, characterized in that the ironing board further comprises locking means for locking the body in the predetermined position.

10. The ironing board as claimed in claim 9, characterized in that the locking means comprises a pivot plate, the pivot plate comprising a slot and a protrusion fitting into the slot.

11. The ironing board as claimed in claim 1, characterized in that the first part of the body is provided with a support element for supporting the second part.

12. The ironing board as claimed in claim 1, characterized in that the folding means is arranged for folding the first work surface and the second work surface towards each other.

13. The ironing board as claimed in claim 1, characterized in that the folding means comprises a hinge, a first part of the hinge being secured to the first part of the body and a second part of the hinge being secured to the second part to the body.

14. The ironing board as claimed in claim 1, characterized in that the ironing board comprises a resilient unit for accompanying folding of the first and second parts, the resilient unit being secured on the one hand to the column and on the other hand to the second part of the body and extending between the column and the second part of the body via the first part of the body.

15. The ironing board as claimed in claim 14, characterized in that the resilient unit comprises a strap fastened to a spring.

16. The ironing board as claimed in claim 12, characterized in that the ironing board has a pressing mode in which the first work surface and the second work surface are oriented facing each other.

17. The ironing board as claimed in claim 16, characterized in that the board comprises a clamping means for pressing the parts towards each other in the pressing mode.

18. The ironing board as claimed in claim 17, characterized in that the clamping means comprises a hook-shaped element secured to the first part of the body and a receiving part at the second part of the body or vice versa.

19. The ironing board as claimed in claim 1, characterized in that the body has a permeable work surface, and the board is provided with an electrical unit for driving a fan for blowing air through the work surface of the body.

20. The ironing board as claimed in claim 19, wherein the electrical unit is provided, characterized in that the board comprises a control unit for controlling the electrical unit.

21. The ironing board as claimed in claim 19, characterized in that the ironing board comprises a vent located on or near a side of the body for blowing out air generated by the fan to refresh an article.

22. The ironing board as claimed in claim 1, characterized in that the board is provided with an electrical unit for driving a fan for blowing or sucking air through the work surface of the body, and wherein the fan is provided, characterized in that the board has an air guiding means for guiding air, mobilized during use by the fan, from the first part of the body to the second part of the body or vice versa.

23. The ironing board as claimed in claim 22, characterized in that the air guiding means comprises a first wall portion of the first part of the body, the first wall portion being located near the folding means and a second wall portion of the second part of the body, the second wall portion being located near the folding means, the first and second wall portions being provided with corresponding openings.

24. The ironing board as claimed in claim 1, characterized in that the ironing board comprises a work surface having a contour corresponding to a contour of a longitudinal section of a torso.

25. A system comprising an ironing board according to claim 1 and an iron and/or garment steamer for cooperation with the ironing board.

26. A method for refreshing an article using an ironing board, said ironing board comprising:

a base;

a body with a permeable work surface, the body having a first longitudinal axis and being connected to the base;

a column extending between the body and the base and having a second longitudinal axis;

tilting means arranged for tilting the body about a tilting axis extending substantially perpendicularly to both the first axis and the second axis;

positioning means for positioning the body in a selected position; and a fan and an electrical unit for driving the fan, the method comprising the steps of:

positioning the body to a position having the first axis at 60-85 degrees relative to the horizontal plane;

attaching the article to the body; and activating the electrical unit, whereby the fan is driven resulting in an air stream flowing through the work surface of the body.

27. The method as claimed in claim 26, characterized in that the work surface of the body of said ironing board has vents thereby effecting the permeability of said work surface, and the step of:

activating the electrical unit, whereby the fan is driven results in an air stream flowing out of the vents of the body.

28. A method for pressing an article using an ironing board, said ironing board comprising:

a base;

a body with a permeable work surface, the body having a first longitudinal axis and being connected to the base;

a column extending between the body and the base and having a second longitudinal axis;

the body comprising a first part having a first work surface and a second part having a second work surface, the first and second parts being connected by folding means, the first part being secured to the column;

clamping means for pressing the first and second parts of the body towards each other; and a fan and an electrical unit for driving the fan, the method comprising the steps of:

placing an article at one part of the body;

folding the first part of the body and the second part of the body towards each other, such that at least a portion of the article is located in-between the first work surface and the second work surface;

clamping the first and second parts with the clamping means; and activating the electrical unit, whereby the fan is driven resulting in an air stream flowing through the work surface of the body.

* * * * *